US010667043B2

(12) United States Patent
Kelly et al.

(10) Patent No.: US 10,667,043 B2
(45) Date of Patent: May 26, 2020

(54) LOUDSPEAKER AND SOUND OUTPUTTING APPARATUS HAVING THE SAME

(71) Applicant: SAMSUNG ELECTRONICS CO., LTD., Suwon-si (KR)

(72) Inventors: Liam Kelly, Suwon-si (KR); Jae-kab Seo, Suwon-si (KR); Ho-seok Wey, Anyang-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/184,488

(22) Filed: Nov. 8, 2018

(65) Prior Publication Data

US 2019/0166421 A1 May 30, 2019

Related U.S. Application Data

(60) Provisional application No. 62/591,388, filed on Nov. 28, 2017.

(30) Foreign Application Priority Data

Aug. 8, 2018 (KR) ..... 10-2018-0092298

(51) Int. Cl.
*H04R 1/34* (2006.01)
*H04R 1/28* (2006.01)
*H04R 1/02* (2006.01)

(52) U.S. Cl.
CPC ..... *H04R 1/345* (2013.01); *H04R 1/025* (2013.01); *H04R 1/2811* (2013.01)

(58) Field of Classification Search
CPC ..... H04R 1/345; H04R 1/025; H04R 1/2811
USPC ..... 381/338
See application file for complete search history.

(56) References Cited

U.S. PATENT DOCUMENTS 5,552,569 A * 9/1996 Sapkowski ..... H04R 1/2865 181/151
7,623,670 B2 11/2009 Hoefler et al.
8,066,095 B1 * 11/2011 Bromer ..... H04R 1/2857 181/148
8,175,311 B2 5/2012 Aylward
(Continued)

FOREIGN PATENT DOCUMENTS

JP 11-234784 A 8/1999
JP 3564102 B2 9/2004
(Continued)

OTHER PUBLICATIONS

International Search Report dated Feb. 15, 2019, issued by the International Searching Authority in counterpart International Patent Application No. PCT/KR2018/013443 (PCT/ISA/210).
(Continued)

*Primary Examiner* — Sean H Nguyen
(74) *Attorney, Agent, or Firm* — Sughrue Mion, PLLC

(57) ABSTRACT

A sound outputting apparatus is provided. The sound outputting apparatus includes at least one loudspeaker, and a main body configured to house the at least one loudspeaker. Each of the at least one loudspeaker includes an acoustic transducer configured to generate a sound wave, and a sound guide part configured to directionally output the sound wave via a plurality of openings. A diameter of each of the plurality of openings is increased as a distance from the acoustic transducer increases.

18 Claims, 21 Drawing Sheets

(56) References Cited

U.S. PATENT DOCUMENTS

| | | | | |
|---|---|---|---|---|
| 8,351,630 | B2 | 1/2013 | Ickler et al. | |
| 2006/0204022 | A1 | 9/2006 | Hooley et al. | |
| 2009/0274329 | A1* | 11/2009 | Ickler | G10K 11/26 381/338 |
| 2010/0260369 | A1* | 10/2010 | Suzuki | H04R 1/342 381/360 |
| 2011/0058700 | A1* | 3/2011 | Clements | H04R 1/2888 381/351 |
| 2012/0308065 | A1 | 12/2012 | Padalino et al. | |
| 2018/0124506 | A1* | 5/2018 | Sun | H04R 1/2857 |

FOREIGN PATENT DOCUMENTS

| | | | |
|---|---|---|---|
| JP | 2009-296153 | A | 12/2009 |
| JP | 4417489 | B2 | 2/2010 |
| KR | 10-2010-0007674 | A | 1/2010 |
| KR | 10-1250647 | B1 | 4/2013 |
| WO | 2016/134861 | A1 | 9/2016 |

OTHER PUBLICATIONS

Written Opinion dated Feb. 15, 2019, issued by the International Searching Authority in counterpart International Patent Application No. PCT/KR2018/013443 (PCT/ISA/237).

K. R. Holland et al., "A Low-Cost End-Fire Acoustic Radiator", Journal of the Audio Engineering Society, vol. 39, No. 7/8, pp. 540-550, Jul./Aug. 1991. (11 pages total).

* cited by examiner

LOUDSPEAKER AND SOUND OUTPUTTING APPARATUS HAVING THE SAME

CROSS-REFERENCE TO RELATED APPLICATION(S)

This application is based on and claims priority under 35 U.S.C. § 119(e) to U.S. Provisional Application No. 62/591,388, filed on Nov. 28, 2017 in the U.S. Patent and Trademark Office, and under 35 U.S.C. § 119(a) to Korean Patent Application No. 10-2018-0092298, filed on Aug. 8, 2018 in the Korean Intellectual Property Office, the disclosures of which are incorporated by reference herein in their entireties.

BACKGROUND

1. Field

The disclosure relates to a loudspeaker with improved directivity and sensitivity and a sound outputting apparatus having the same.

2. Description of Related Art

A loudspeaker is an apparatus that generates a sound wave by applying an electrical signal received from a television, a radio, etc. to to a diaphragm provided in the loudspeaker or the like to vibrate it, such that a sound wave corresponding to the vibration of the diaphragm is generated in the air. A loudspeaker may be an omni-directional loudspeaker from which a generated sound wave is output not in a particular direction but evenly in all directions, or a directional loudspeaker driver from which a generated sound wave is output in a particular direction.

In recent years, the advancement of image media such as movies, dramas, and the like reproduced in an indoor space has enabled image media to include a stereophonic sound field content. A loudspeaker outputs the stereophonic sound field content in the form of a sound wave. However, only a portion of the output sound wave is transmitted to the listener.

In this aspect, a directional loudspeaker has become more widely used since it may output a sound wave to a particular direction of an interior wall surface, etc., implement a stereophonic sound wave to a user through a sound wave reflected from the interior wall surface, and provide an auditory illusion.

To implement such effects, in related art, a plurality of omni-directional loudspeakers are set to be arranged in a line. However, such setting requires a plurality of omni-directional loudspeakers, which is costly.

The above information is presented as background information only to assist with an understanding of the disclosure. No determination has been made, and no assertion is made, as to whether any of the above might be applicable as prior art with regard to the disclosure.

SUMMARY

Aspects of the disclosure address at least the above-mentioned problems and/or disadvantages and to provide at least the advantages described below. However, an aspect of the disclosure are not required to overcome the above-mentioned problems and/or disadvantages described above, and an aspect of the disclosure may not overcome any of the above-mentioned problems and/or disadvantages described above.

Provided are a loudspeaker with improved directivity and sensitivity using a plurality of openings of variable sizes and a sound outputting apparatus having the same.

In accordance with an aspect of the disclosure, a sound outputting apparatus is provided. The apparatus includes at least one loudspeaker, and a main body configured to house the at least one loudspeaker. Each of the at least one loudspeaker may include an acoustic transducer configured to generate a sound wave, and a sound guide part configured to directionally output the sound wave via a plurality of openings. A diameter of each of the plurality of openings may be increased as a distance from the acoustic transducer increases.

The diameter of each of the plurality of openings may be increased at a non-linear ratio along a longitudinal direction of the sound guide part.

The plurality of openings may include a plurality of first openings each having a diameter that steadily increases as a distance from the acoustic transducer increases along a longitudinal direction of the sound guide part, and a plurality of second openings consecutively disposed following the plurality of first openings and each of the plurality of second openings having a same diameter.

The plurality of openings may include a plurality of third openings each having a diameter that steadily increases according to a first ratio as a distance from the acoustic transducer increases along a longitudinal direction of the sound guide part, and a plurality of fourth openings consecutively disposed following the plurality of third openings, and each of the plurality of fourth openings having a diameter that is steadily increased according to a second ratio as a distance from the plurality of third openings increases. The first ratio may be larger than the second ratio.

The plurality of openings are disposed in a plurality of rows along a longitudinal direction of the sound guide part.

The plurality of openings may be disposed of a sinusoidal wave pattern along a longitudinal direction of the sound guide part.

The sound guide part may be a bar-shaped. The plurality of openings may be disposed in a pattern that covers a circumference of the sound guide part.

Additional openings each having a smaller diameter than any of the plurality of openings may be respectively disposed between adjacent openings of the plurality of openings.

A cross-section of the sound guide part may have a circular shape. A cross-sectional area of the sound guide part may decrease from a first end of the sound guide part to a second end of the sound guide part. The acoustic transducer may be disposed at the first end of the sound guide part.

The sound outputting apparatus may further include an acoustic resistant member. The acoustic transducer may be disposed at a first end of the sound guide part, and the acoustic resistant member may be disposed at a second end of the sound guide part.

The sound guide part may include a protrusion member configured to be protruded from inside the sound guide part toward an inner direction and to filter out the sound wave generated in the acoustic transducer in a particular frequency band.

A cross-sectional area of the protrusion member may be 0.1 to 0.7 times a cross-sectional area of the sound guide part.

A distance from a first end of the sound guide part at which the acoustic transducer is disposed to the protrusion member may be less than 0.2 times a largest diameter of an inner cross-sectional area of the sound guide part.

The sound outputting apparatus may further include a pipe member disposed between a first end of the sound guide part and the acoustic transducer, and filtering out the sound wave in a particular frequency band.

In accordance with another aspect of the disclosure, a loudspeaker is provided. The loudspeaker includes an acoustic transducer configured to generate a sound wave, and a sound guide part configured to directionally output the sound wave via a plurality of openings. The acoustic transducer may be configured to be disposed at one end of the sound guide part and to transfer the sound wave to the sound guide part. The plurality of openings may be disposed along a longitudinal direction of the sound guide part. A diameter of each of the plurality of openings may be increased as a distance from the acoustic transducer increases.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, and advantages of certain embodiments of the disclosure will be more apparent from the following description taken in conjunction with the accompanying drawings, in which.

DETAILED DESCRIPTION

Figure 1:
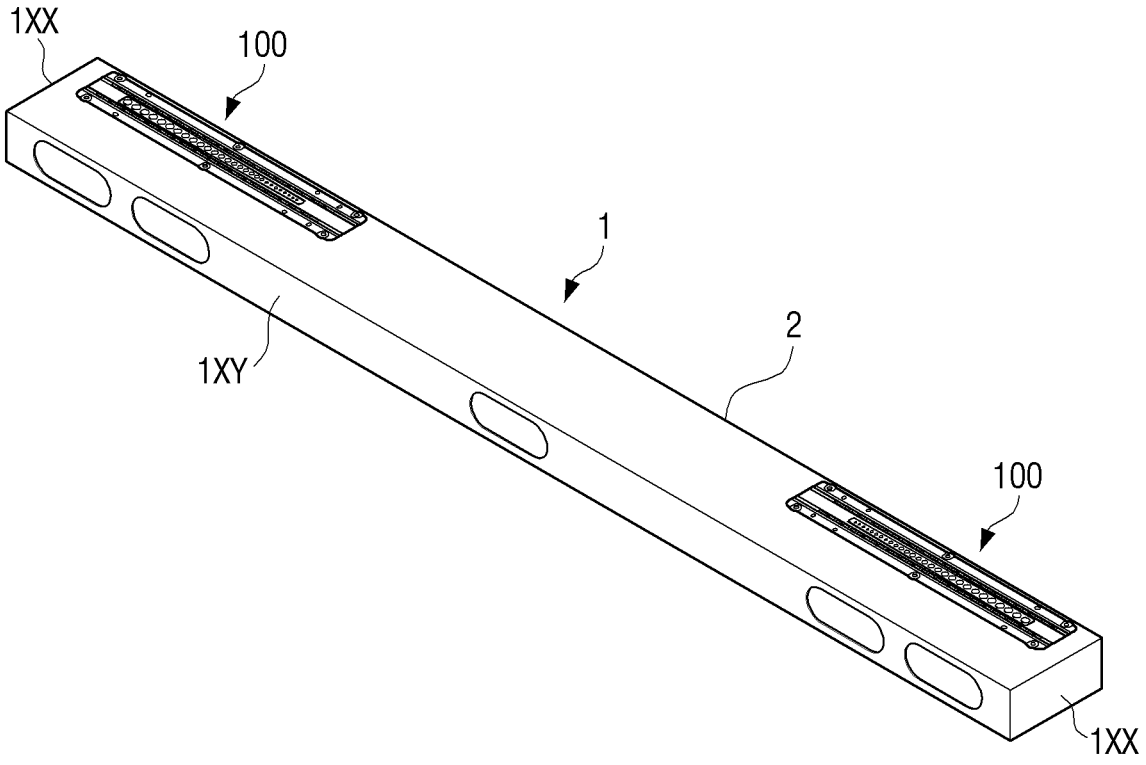
FIG. 1 is a perspective view of a sound outputting apparatus, according to an embodiment.

Certain embodiments will now be described in greater detail with reference to the accompanying drawings. In the following description, same drawing reference numerals are used for the same elements, even in different drawings. However, it is to be understood that the present disclosure is not limited to specific embodiments, but includes all modifications without departing from the scope and spirit of the present disclosure. The description of the embodiments complete the present disclosure and is provided to give information of the full scope of the invention to those skilled in the art. In the accompanying drawings, the elements are illustrated in enlarged scale for the convenience of explanation, and the ratio of each of the elements may be exaggerated or reduced.

It is to be understood that when an element is referred to as being "on" or "in contact with" another element, it may be directly in contact with or connected to the other element, but it should be understood that there may be other components in between. In contrast, when an element is referred to as being "directly on" or "directly in contact with" another element, it may be understood that there may not be other components in between. Other expressions explaining a relationship between components, such as "between" and "directly between," may be understood likewise.

In the disclosure, relational terms such as first and second, and the like, may be used to distinguish one entity from another entity, without necessarily implying any actual relationship or order between such entities. The terms may be only used to differentiate one component from other components. For example, the 'first' component may be named the 'second' component, and vice versa, without departing from the scope of the present disclosure.

It is to be understood that the singular forms "a," "an," and "the" include plural referents unless the context clearly dictates otherwise. Throughout this specification, it will be understood that the term "comprise" and variations thereof, such as "comprising" and "comprises," specify the presence of features, numbers, steps, operations, components, parts, or combinations thereof, described in the specification, but do not preclude the presence or addition of one or more other features, numbers, steps, operations, components, parts, or combinations thereof.

Unless indicated otherwise, it is to be understood that all the terms used in the disclosure including technical and scientific terms has the same meaning as those that are understood by those who skilled in the art.

FIG. 1 is a perspective view of a sound outputting apparatus 1, according to an embodiment.

A structure of a loudspeaker and a sound outputting apparatus including a plurality of loudspeakers according to an embodiment will be described in detail below with reference to the accompanying drawings.

The sound outputting apparatus 1 may include a main body 2 and a plurality of loudspeakers 100. The sound outputting apparatus 1 may be an electronic device having a loudspeaker, such as a home theater system (HTS), a sound bar, a television, a digital TV, a radio, a personal computer, a notebook, and the like.

The main body 2 may form an appearance of the sound outputting apparatus 1 and may contain the plurality of loudspeakers 100. In the example illustrated, only two loudspeakers are included in two main bodies 2. However, in an implementation, the main body 2 may include one loudspeaker or three or more loudspeakers. In addition, the main body may include two loudspeakers and an additional woofer loudspeaker.

Specifically, as illustrated in FIG. 1, the main body 2 may be a bar shape having end sides/areas 1XX and a front side/area 1XY. In addition, the plurality of loudspeakers 100 may be disposed in the main body 2.

Accordingly, the sound outputting apparatus 1 may radiate a sound wave (a sound) generated in the loudspeaker 100 to an indoor wall surface in a predetermined direction, improving directivity of the sound outputting apparatus 1.

However, an appearance of the main body 2 is not limited to a bar shape, and may be of various shapes as occasion demands. Further, a plurality of loudspeakers 100 contained in the main body 2 may be variously disposed in the main body 2, if the directivity to the wall surface can be improved.

Each of the plurality of loudspeakers 100 may generate a sound wave, and output the generated sound wave to a predetermined direction. Each of the plurality of loudspeakers 100 may output different sound waves, or may output the same sound wave. A detailed structure and operation of such a loudspeaker will be described below with reference to FIGS. 2, 3, 4A, 4B, 4C, 4D, and 5.

In FIG. 1, the sound outputting apparatus 1 performs only a function of outputting a sound wave. However, the sound outputting apparatus 1 may further include other components such as a display and the like.

FIG. 1 illustrates an instrumental configuration of the sound outputting apparatus 1. However, in an implementation, the sound outputting apparatus 1 may further include a communication apparatus configured to receive a sound source data from an external source, an amplifier configured to drive the acoustic transducer 140 based on the received sound source data, and etc.

Figure 2:
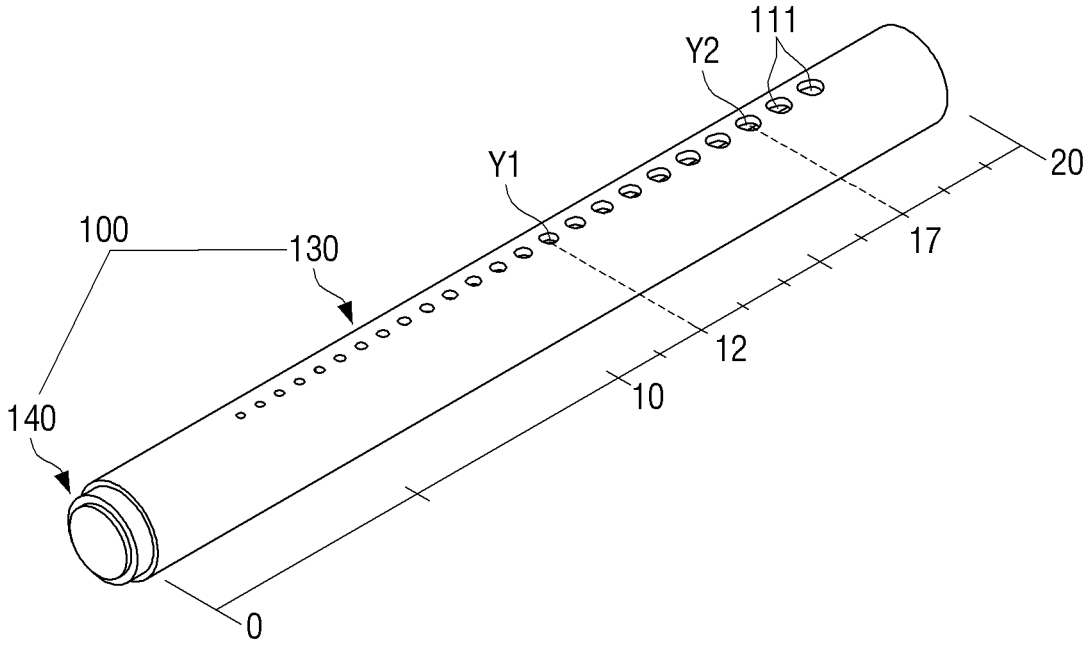
FIG. 2 is a perspective view of a loudspeaker, according to an embodiment.
Figure 3:
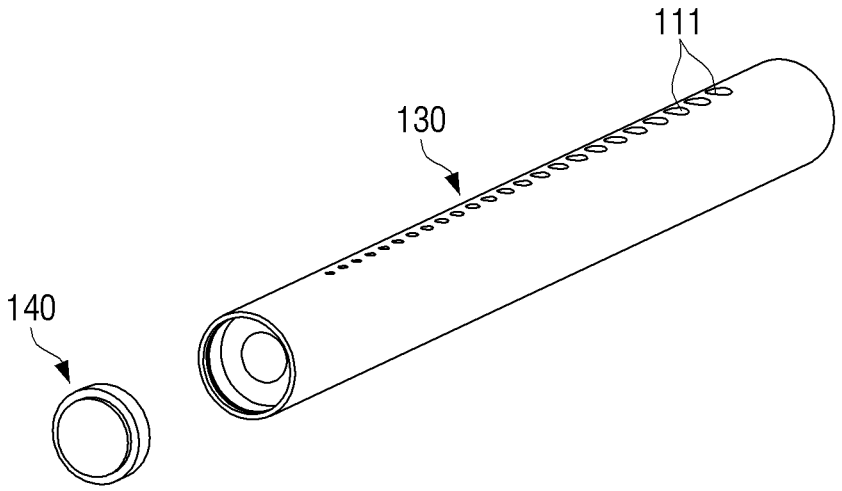
FIG. 3 is an exploded perspective view of a sound guide part and an acoustic transducer.

FIG. 2 is a perspective view illustrating a loudspeaker 100, according to an embodiment. FIG. 3 is an exploded perspective view of a sound guide part 130 and an acoustic transducer 140. FIGS. 4A, 4B, 4C, and 4D are perspective views illustrating an embodiment of the sound guide part 130. FIG. 5 is a cross-sectional view of a loudspeaker 100 of FIG. 2.

The loudspeaker 100 is a directional loudspeaker that generates a sound wave to a particular direction, which may include a sound guide part 130 which serves as an outlet that radiates a sound wave, an acoustic transducer 140 which generates a sound wave, and an acoustic resistant member 150.

The acoustic transducer 140 may generate a sound wave. In detail, the acoustic transducer 140 may generate a sound wave by vibration based on an amplification signal corresponding to a sound source content stored in the sound outputting apparatus 1 or a sound source content provided from an external source. The acoustic transducer 140 may use a permanent magnetic method, a voice coil method, and an electrodynamic method. The acoustic transducer 140 may be referred to as a loudspeaker or a loudspeaker unit.

The sound guide part 130 may be formed to extend from one end 101 at which the acoustic transducer 140 is disposed. In addition, a plurality of openings 111 may be formed on one side of the sound guide part 130 in a predetermined pattern along a longitudinal direction of the sound guide part 130. The forms of the plurality of openings will be described later with reference to FIGS. 2, 3, 4A, 4B, 4C and 4D.

The longitudinal direction of the sound guide part 130 may refer to the longest longitudinal direction of the sound guide part 130.

Accordingly, the sound guide part 130 may transfer a sound wave generated in the acoustic transducer 140 to the outside. In particular, the sound guide part 130 may guide a sound wave to a particular direction (e.g., a direction in which a plurality of openings are disposed) so that the sound wave is directed in the particular direction.

A size of internal maximum cross-section of the sound guide part 130 may be designed to be shorter than a half wavelength of a frequency component for which the high-directional sound wave radiation is to be performed.

In addition, as illustrated in FIGS. 4A-4D, the sound guide parts 130*a*-130*d* may be configured such that the internal cross-sectional area of the sound guide parts 130*a*-130*d* is gradually decreased, increased, or made constant depending on the position where the distance from the acoustic transducer 140 is increased.

A cross-sectional shape of the sound guide parts 130*a*-130*d* may be fixed to a particular shape such as a curved surface, a many-sided surface and an ellipsoid, or may be designed in a form of a particular pipe of which a cross-sectional shape and cross-sectional area are continuously changed for each position as a distance from the sound guide part from the acoustic transducer 140 is increased.

Figure 4A:
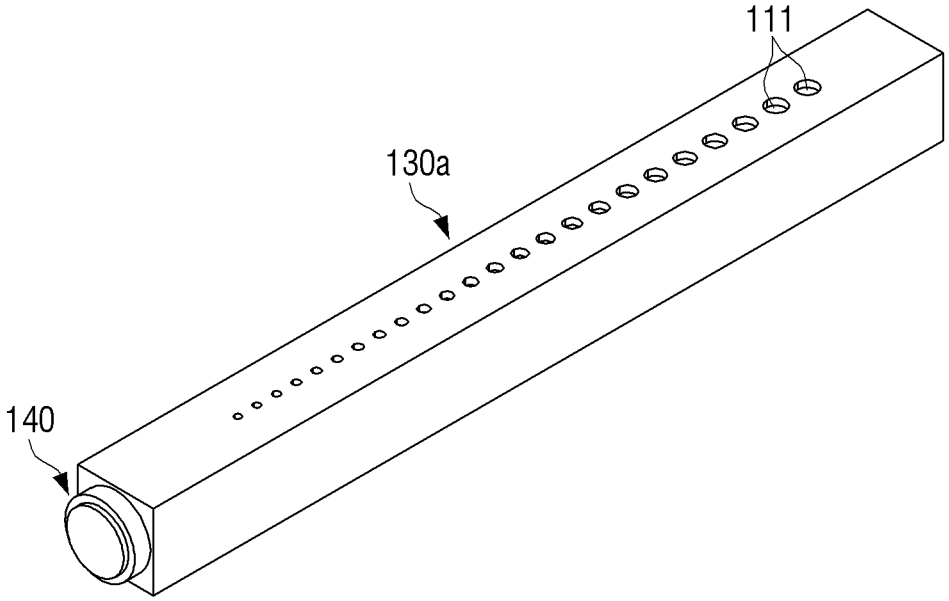
FIGS. 4A, 4B, 4C, and 4D are perspective views of an embodiment of a sound guide part.
Figure 4B:
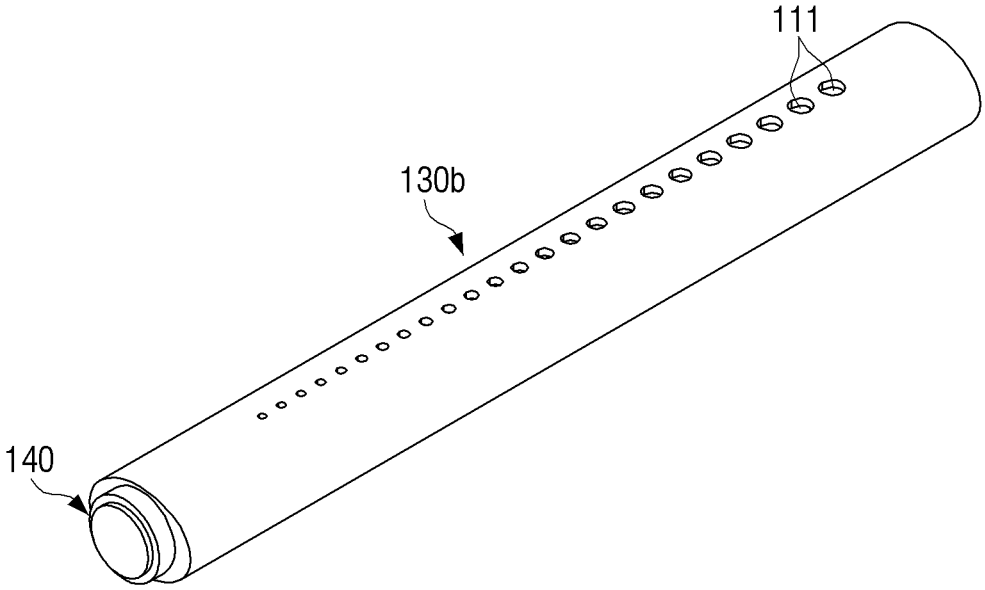
Figure 4C:
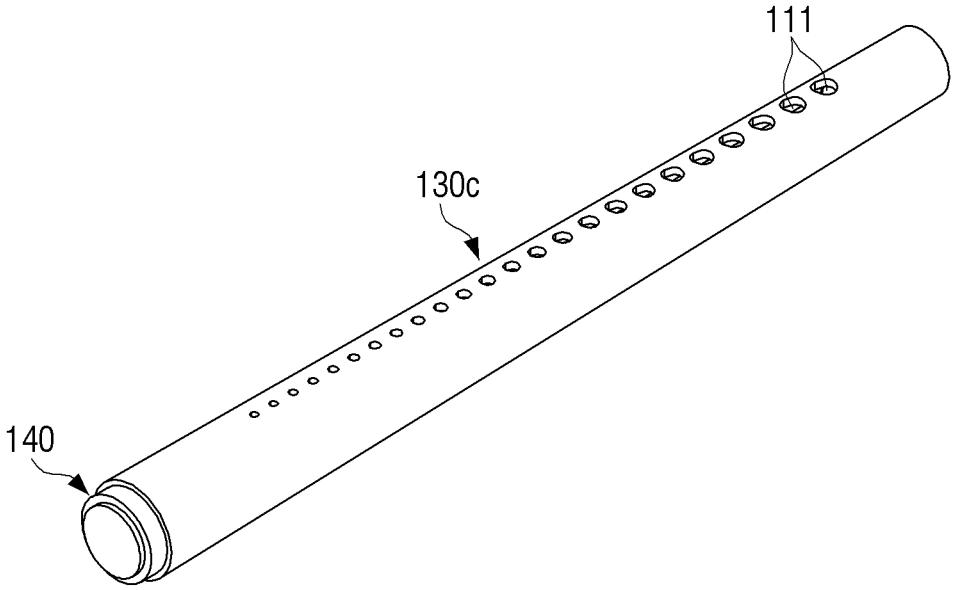
Figure 4D:
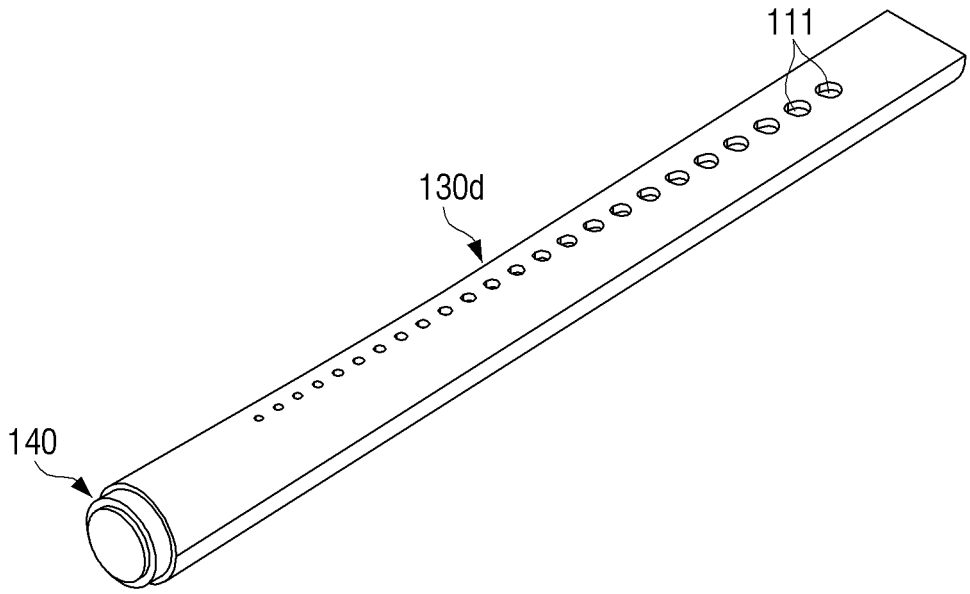
Figure 5:
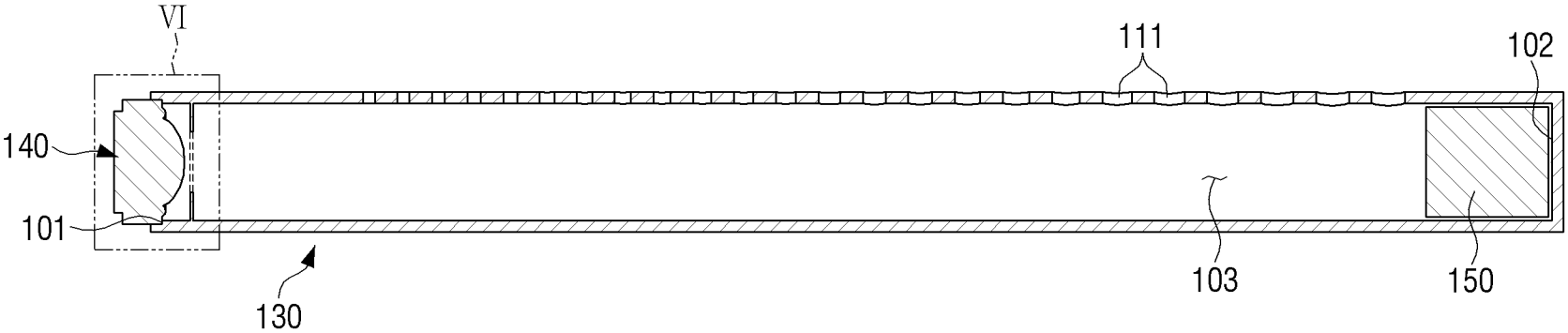
FIG. 5 is a cross-sectional view of a loudspeaker of FIG. 2.

In particular, as illustrated in FIG. 4C, an internal cross-sectional area of a sound guide space may be reduced as a distance between the sound guide part 130*c* the acoustic transducer 140 is increased.

Accordingly, the sensitivity of sound waves of various frequency areas may be increased. That is, a change of internal cross-sectional area of the sound guide space 103 may variously change a bandwidth associated with the sensitivity of sound waves of a low-frequency area and a high-frequency area.

In addition, as illustrated in FIG. 5, the sound guide part 130 may include a sound guide space 103 which is connected to a plurality of openings 111.

An inner surface of the sound guide part 130 is formed as a curved surface, and thereby the sound guide space 103 may be formed in the sound guide part 130.

A length of the sound guide space 103 may be the same as the longest wavelength of a sound wave generated from the acoustic transducer 140. Accordingly, even if a sound wave generated in the acoustic transducer 140 is collided, reflected and refracted from an inner surface of the sound guide part 130, the sound wave may be transferred to the outside via the plurality of openings 111 without loss of a sound wave of various frequencies.

In addition, the sound guide part 130 may be injection-molded and integrally formed. Accordingly, the sound guide part 130 is manufactured without an additional assembly process, thereby reducing the manufacturing time and cost.

However, the example is not limited to a case where the sound guide part 130 is integrally formed. The sound guide part 130 may be formed in a method of a coupled structure including an upper component and a lower component as necessary, and various methods and structures of coupling may be possible.

Further, the sound guide part 130 may include a protrusion part 106 which is capable of increasing high-frequency sensitivity of a sound wave. Specific constitution and operation of the protrusion part 106 will be described below by referring to FIGS. 5 and 6.

In addition, a space for the acoustic resistant member 150 may be formed on the other side 102 of the sound guide part 130. Accordingly, the acoustic resistant member 150 may be adjacent to the other end 102 of the sound guide part 130 and stably disposed.

The acoustic resistant member 150 may be disposed as being adjacent to the other end 102 of the sound guide part 130, and may reduce reflection of a sound wave generated from the acoustic transducer 140 disposed at one end 101 of the sound guide part 130 from the other end 102 of the sound guide part 130.

In addition, the acoustic resistant member 150 may serve as a damper of a sound wave, which may absorb a sound wave according to materials and design and reduce an unwanted reflected wave generated in the sound guide part 130. This reflective wave may implement an unwanted frequency response and reduce directivity of a loudspeaker. Accordingly, the acoustic resistant member 150 may change a frequency response and directional characteristics of a sound wave.

A detailed structure of the plurality of openings 111 will be described in detail below with reference to FIG. 2.

The plurality of openings 111 may be formed on one side of the sound guide part 130 in a predetermined pattern along a longitudinal direction of the sound guide part 130.

The plurality of openings 111 may be connected to the sound guide space 103.

A size of each of the plurality of openings 111 may be determined according to a distance from the acoustic transducer 140. The determination may be made in various ways depending on embodiments.

For example, as illustrated in FIG. 2, the plurality of openings 111 may be formed such that a diameter of each opening is increased as a distance from the acoustic transducer 140 along a longitudinal direction of the sound guide part 130 is increased. In this case, a diameter of the opening 111 disposed farthest from the sound guide part 130 from among the plurality of openings 111 may be maximized.

In addition, a relationship between diameters of each of the plurality of openings 111 may be designed to an optimum value through repeated experiments.

For example, as illustrated in FIG. 2, a distance from one end at which the acoustic transducer 140 is installed to the other end is divided into 20 levels, and that an opening Y1 disposed at a point corresponding to a 12th level from the acoustic transducer 140 (i.e., a point corresponding to 12/20) and an opening Y2 disposed at a point corresponding to a 17th level from the acoustic transducer 140 (i.e., a point corresponding to 17/20) are present. In this case, if it is assumed that a square root of a diameter of Y1 is a1 and that a square root of a diameter of Y2 is a2, a2/a1 may be set to be larger than 21/20.

In addition, the sensitivity of a sound wave may be increased as the sum of all surface areas of the plurality of openings 111 increases. However, as a size of the plurality of openings 111 increases, the directivity of a sound wave may be reduced. Thus, in an implementation, a size of the plurality of openings 111 may be designed in consideration of the sensitivity and directivity of the loudspeaker 100.

For example, a ratio of the sum of all surface areas of the plurality of openings 111 to a surface area of an upper surface of the sound guide part 130 in which the plurality of openings 111 are not formed may be a ratio determined in the range of $10^{-6}$ to 0.35. Accordingly, the sensitivity of sound waves of various frequency areas may be increased while the directivity is maintained.

Each of the plurality of openings 111 may include a fabric material which serves as sound resistance. A sound wave radiation characteristic of each opening may be precisely adjusted using a fabric material.

For example, an opening close to the acoustic transducer 140 may have a thick fabric material. As a distance from the acoustic transducer 140 increases, an opening may have a fabric material that becomes thinner.

In the embodiment described above, a thickness of a fabric material is changed based on a distance from acoustic transducer. However, in an implementation, a thickness of a fabric material may be changed based on a diameter of an opening.

For example, as illustrated in FIG. 2, a diameter of a plurality of openings is increased as a distance from the acoustic transducer 140 increases, but a thickness of a fabric material may be gradually thinned in inverse proportion to a diameter of an opening.

An unwanted low-frequency resonance component may be damped by covering an opening with a small thickness (or an opening adjacent to an acoustic transducer) with a thick fabric material, and thereby a flatness of the loudspeaker 100 for a frequency band may be enhanced.

In particular, a thick fabric material may serve as "a sound radio wave characteristic adjuster" for enhancing radiation directivity of a low-frequency sound wave component by covering an opening having a small thickness (or an opening adjacent to an acoustic transducer).

Further, a fabric material may be of various materials including jersey.

Meanwhile, small-sized openings from among the plurality of openings 111 may affect sound wave radiation of a low-frequency band, and large-sized openings from among the plurality of openings may affect sound wave radiation of a high-frequency band.

Accordingly, the loudspeaker 100 according to an embodiment may not have openings of the same size but have openings of different sizes and thus, a directional characteristic is enhanced from the high-frequency band to the low-frequency band as a whole.

The plurality of openings 111 may be disposed in a plurality of rows along a longitudinal direction of the sound guide part. The plurality of rows may be disposed at predetermined intervals, and each of the plurality of rows may be freely disposed by a straight line, a curved line, or the like.

A detailed structure of the protrusion area 106 will be described in detail below with reference to FIGS. 5 and 6.

FIG. 5 is a cross-sectional view of a loudspeaker 100 of FIG. 2. FIG. 6 is an enlarged view of a part VI of FIG. 4.

Figure 6:
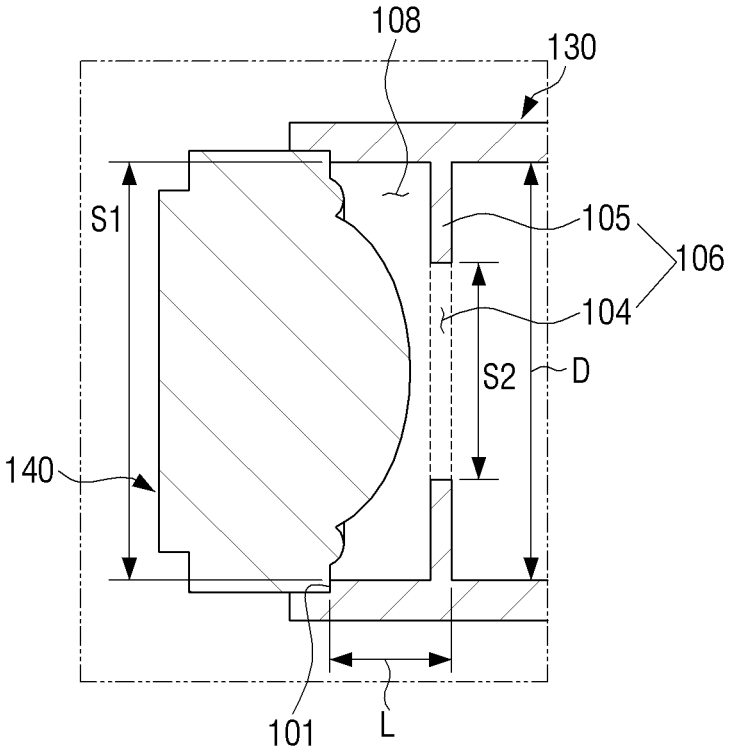
FIG. 6 is an enlarged view of a part VI of FIG. 5.

Referring to FIGS. 5 and 6, the sound guide part 130 may include a protrusion area 106 which is protruded toward an inner center of the sound guide part 130 along an inner edge of the sound guide part 130 on one side adjacent to one end 101 of the sound guide part 130 in which the acoustic transducer 140 is disposed.

In addition, the sound guide part 130 may include a protrusion member 105 which is protruded toward an inner center of the sound guide part 130 along an inner edge of the sound guide part 130 and forms the protrusion part 106.

The protrusion member 105 may be, as an additional member, fixed along an inner edge of the sound guide part 130, or may be integrally injection-molded with the sound guide part 130 as necessary.

The protrusion member 105 may be protruded toward an inner center of the sound guide part 130 along an inner edge of the sound guide part 130, and form a sound connecting hole 104 connects the sound guide space 103 to a sound inlet 108 which is a space between the acoustic transducer 140 disposed at one end 101 of the sound guide part 130 and the protrusion area 106.

In addition, in a case in which the sound guide part 130 includes an additional pipe member or formed as a pipe member, the pipe member may be formed to extend from the one end 101, and bent to form a protrusion area 106 on one side adjacent to the one end 101 at which the acoustic transducer 140 is disposed.

In addition, the pipe member may be an additional member of the sound guide part 130, which may be connected to one side of the sound guide part 130 and coupled to the acoustic transducer 140, and filter a sound wave at a particular frequency band.

Accordingly, it is possible to manufacture an additional pipe member including the protrusion area 106 and connect it with the sound guide part 130.

A cross-sectional area S2 of the protrusion area 106 may be smaller than a cross-sectional area S1 of the sound guide part 130 on one side where the acoustic transducer 140 is disposed. For example, the cross-sectional area S2 of the protrusion area 106 may be 0.1 to 0.7 times the cross-sectional area of the sound guide part 130 where the acoustic transducer 140 is disposed.

In detail, the cross-sectional area S2 included in the protrusion area 106 and perpendicular to a longitudinal direction of the sound guide part 130 of the sound connecting hole 104 may be formed to be smaller than a cross-sectional area S1 which is perpendicular to a longitudinal direction of the sound guide part 130 of the sound inlet 108.

In addition, in a case in which a cross-sectional area of the sound connecting hole 104 included in the protrusion area 106 is changed, a minimum cross-sectional area S2 of the sound connecting hole 104 may be formed to be smaller than a cross-sectional area S1 of the sound inlet 108.

In addition, a distance L from one end 101 of the sound guide part 130 to the protrusion area 106 may be less than the largest diameter D from among an inner cross-sectional area of the sound guide part 130. For example, a distance L from one end 101 of the sound guide part 130 to the protrusion area 106 may be less than 0.2 times the largest diameter D from among an inner cross-sectional area of the sound guide part 130.

Accordingly, it is possible to increase the sensitivity of a particular frequency band while maintaining a predetermined level of directivity.

Further, the protrusion area 106 may be disposed between the sound inlet 108 and the sound guide space 103 and connect the sound inlet 108 to the sound guide space 103.

In detail, the protrusion area 106 may connect the sound inlet 108 with the sound guide space 103 via the sound connecting hole 104.

Accordingly, a sound generated in the acoustic transducer 140 may be sequentially transferred to the outside through the sound inlet 108, the sound connecting hole 104, the sound guide space 103, and a plurality of openings 111.

In addition, as illustrated in FIG. 5, a lower inner surface of the sound guide part 130 may be parallel to an upper inner surface parallel to a longitudinal direction of the sound guide part 130. However, the lower inner surface of the sound guide part 130 may also be inclined at a predetermined angle with respect to the upper inner surface of the sound guide part 130.

Figure 7:
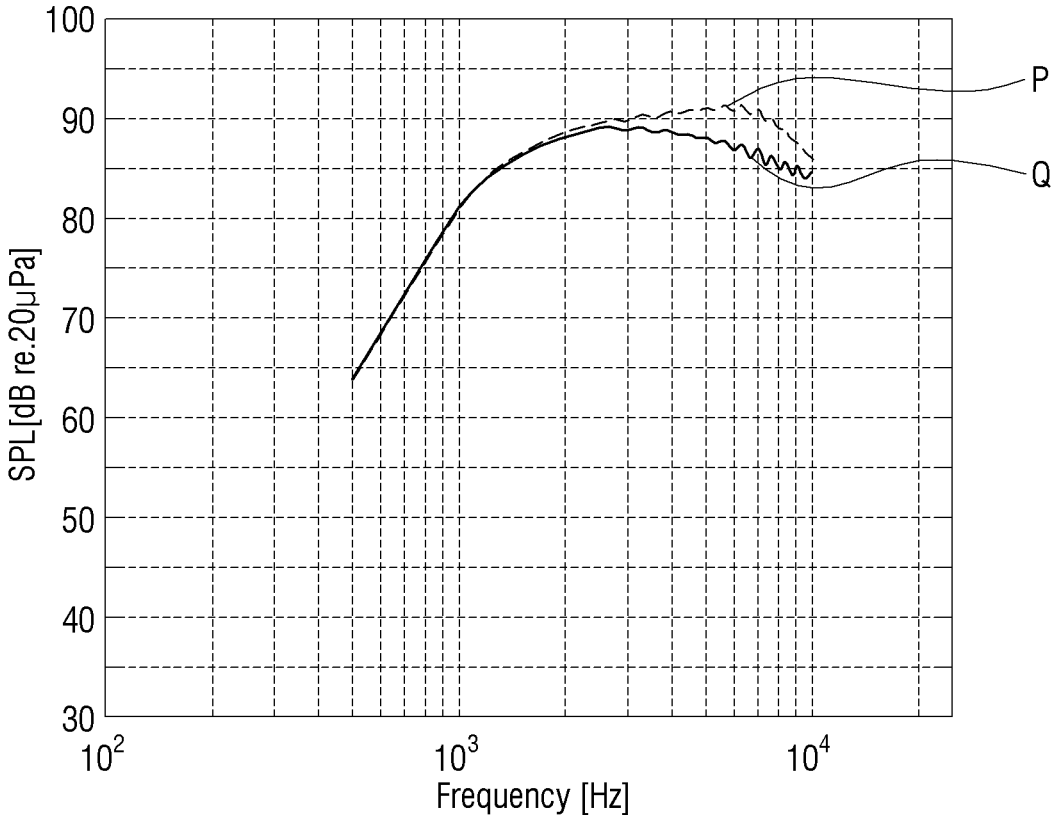
FIG. 7 is a graph that illustrates sensitivity according to a frequency of a sound guide part including a protrusion area and a sound guide part not including a protrusion area.

FIG. 7 is a graph that illustrates a sensitivity characteristic of each of a sound guide part P including the protrusion area 106 and a sound guide part Q not including a protrusion area.

Referring to FIG. 7, the SPL refers to a sound pressure level and refers to a sensitivity of a sound wave measured at a particular location from the acoustic transducer 140. The sound guide part 130 including the protrusion area 106 may function as a sound filter for increasing a sensitivity of a particular frequency (e.g., low to medium frequency). As a result, it can be understood from FIG. 7 that a graph Q of a sound guide part not including the protrusion area 106 is superior to a graph P of a sound guide part including the protrusion area 106.

A change of diameter of a plurality of openings 1111 and an effect thereof will be described in detail below with reference to FIGS. 8-10.

Figure 8:
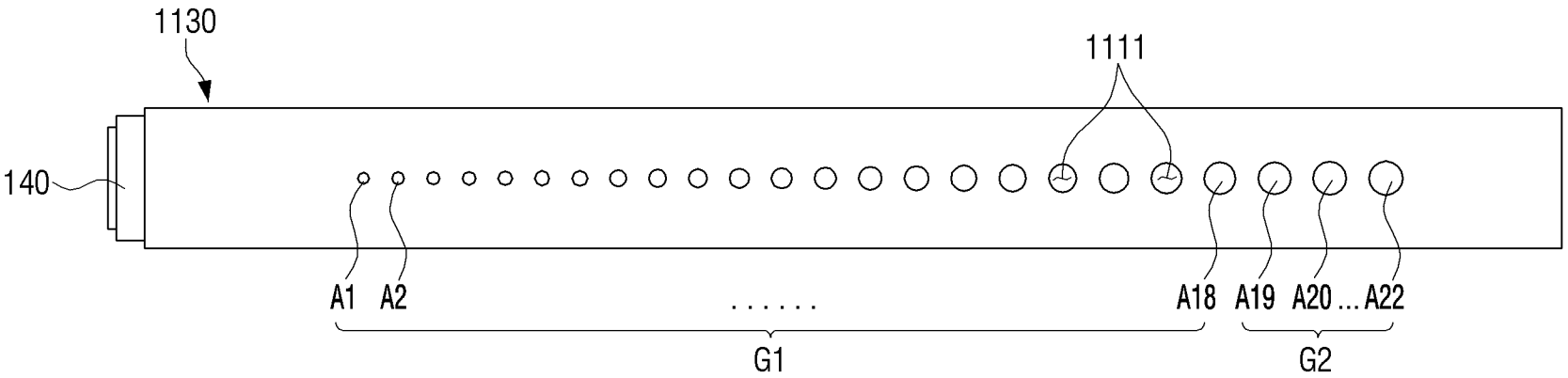
FIG. 8 is a top view illustrating a sound guide part, according to an embodiment.

FIG. 8 is a top view illustrating a sound guide part 1130, according to an embodiment. FIG. 9 is a graph illustrating development of changes of diameter of the plurality of openings 1111 of FIG. 8 according to a distance from the acoustic transducer 140. FIG. 10 is a graph illustrating a change of directivity according to a structure of FIG. 8.

The plurality of openings 1111 may be, as described above, formed on one side of the sound guide part 1130. The connection structure with the sound guide part 103 is the same as above and thus will not be further explained below for the sake of brevity.

Figure 9:
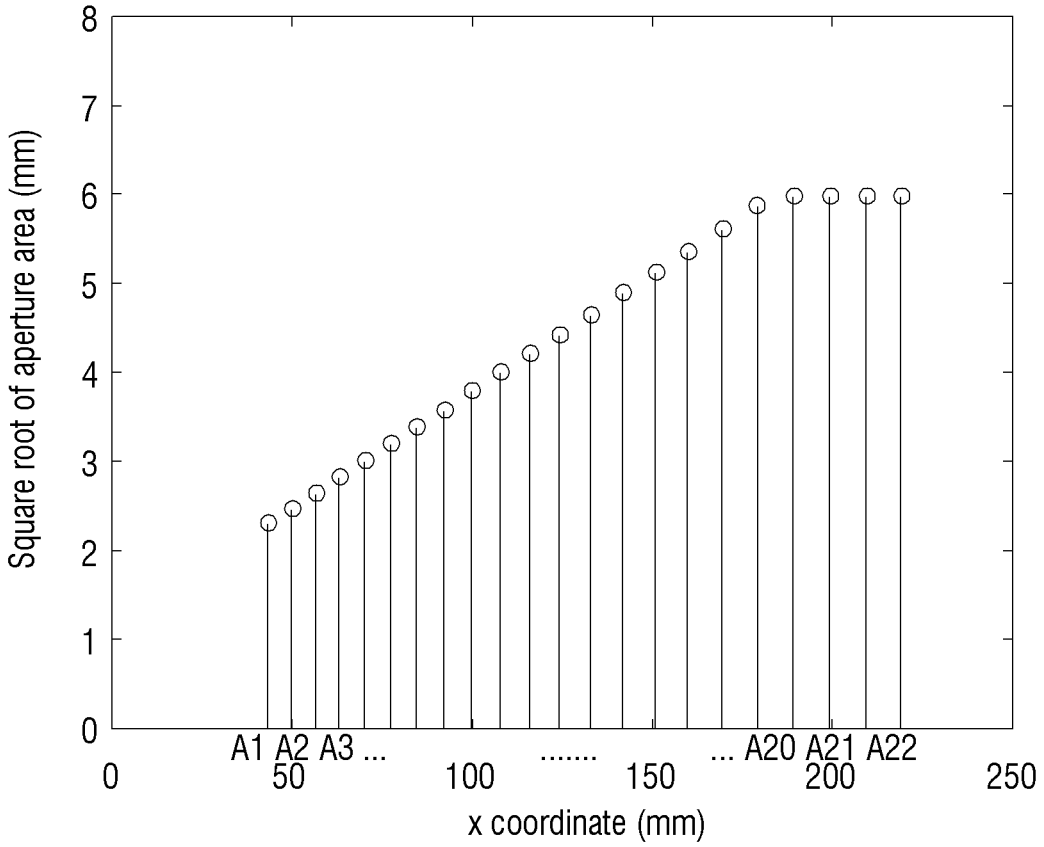
FIG. 9 is a graph that illustrates a change of diameters of a plurality of openings of FIG. 8 according to a distance from an acoustic transducer.

As illustrated in FIGS. 8 and 9, the sound guide part 1130 may include a plurality of openings (A1-A22) of the same diameter as the plurality of openings 1111 of which a diameter is varied.

The plurality of openings 1111 of which a diameter is varied may have a diameter that is increased as a distance from the acoustic transducer 140 increases.

The plurality of openings A1-A22 may be disposed after the plurality openings 1111 whose diameter is varied, and may have diameters of the same size. A size of the plurality of openings A1-A22 may be identical to or larger than that of an opening disposed at the rightmost side of the plurality of openings 1111 with variable diameters.

For example, the plurality of openings 1111 may be represented as a plurality of first openings G1 of which a diameter is steadily increased as a distance from the acoustic transducer 140 increases along a longitudinal direction of the sound guide part 1130 and a plurality of second openings G2 consecutively disposed following the plurality of first openings G1 and having the same diameter.

In detail, as illustrated in FIG. 8, the plurality of first openings G1 include openings A1-A18 of which a diameter is steadily increased, and the plurality of second openings G2 may include openings A19-A22 of a constant diameter.

Further, as can be understood from FIG. 9, as a distance from the acoustic transducer 140 is increased, a diameter of openings A1-A18 included in the plurality of first openings G1 may steadily increase, and the openings A19-A22 included in the plurality of second openings G2 may be larger in diameter than the opening A18 having the largest diameter among the openings included in the plurality of first openings G1 and may have a constant diameter.

The origin of an x-axis illustrated in FIG. 9 indicates a position at which the acoustic transducer 140 is disposed. However, if necessary, the openings A19-A22 included in the plurality of second openings G2 may be identical in diameter to the opening A19 having the largest diameter among the openings included in the plurality of first openings G1.

Figure 10:
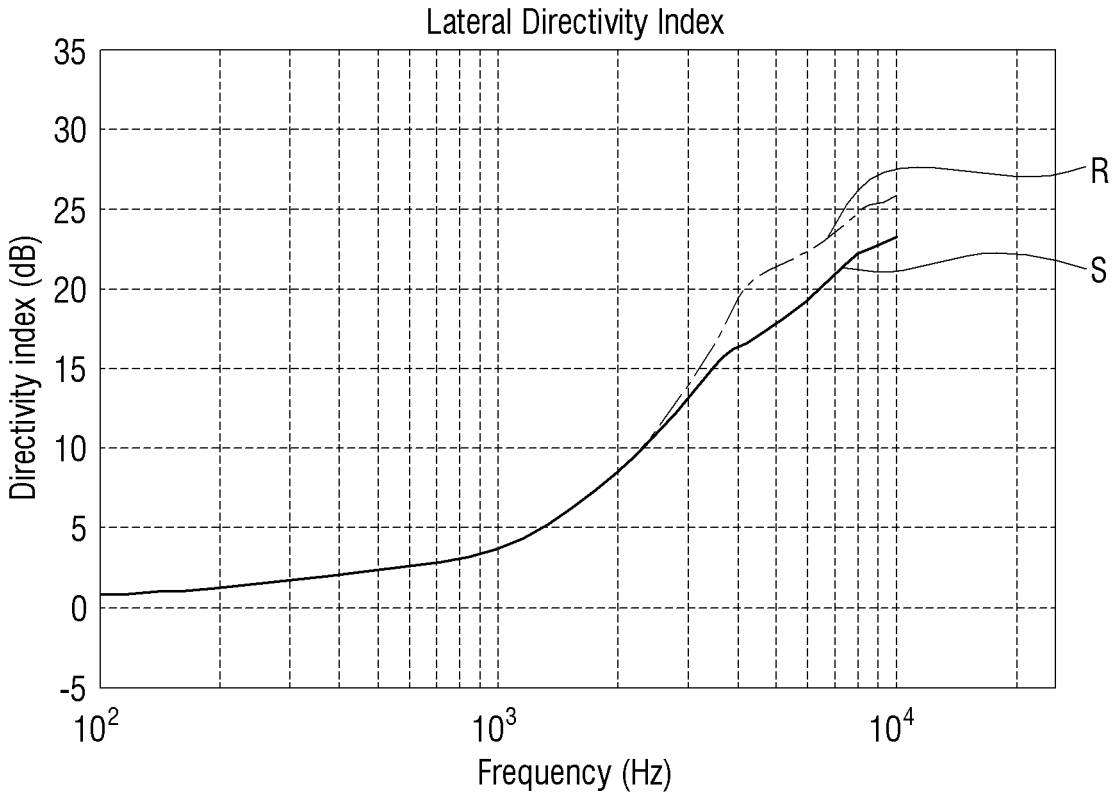
FIG. 10 is a graph that illustrates a change of directivity according to a structure of FIG. 8.

Accordingly, as can be understood from FIG. 10, the sensitivity (SPL) in accordance with a frequency area of a sound wave may be indicated higher in a graph R of the sound guide part 1130 including the plurality of first and second openings G1 and G2 according to an embodiment than a graph S of the sound guide part 130 including the plurality of openings 111.

In detail, it may be understood that when the sound guide part 130 includes a characteristic of a diameter of the second opening G2, the sensitivity (SPL) is increased in an overall frequency area, a high-frequency area in particular.

The graph of FIG. 10 shows an example of a comparison regarding a sound wave radiation directional characteristic obtained through the sound outputting apparatus based on the prior art and the technique of an embodiment of the disclosure.

A standard of measurement used in the graph of FIG. 10 is a 'lateral directivity index' which corresponds to a revised edition of a standard for directional characteristics of sound wave radiation standardized as ANSI/CEA-2034-A (2015).

In detail, the lateral directivity index is a value that corresponds to a difference between a "listening window" defined on the standard document and a sound pressure level on a side (1XX) of the sound outputting apparatus 1.

The 'listening window' corresponds to an average value of sound pressure level values measured at 9 different places on the front side which may be regarded as the "front" area 1XY of the sound outputting apparatus 1.

A change of diameter of a plurality of openings 2111 and an effect thereof will be described in detail below with reference to FIGS. 11 and 12.

Figure 11:
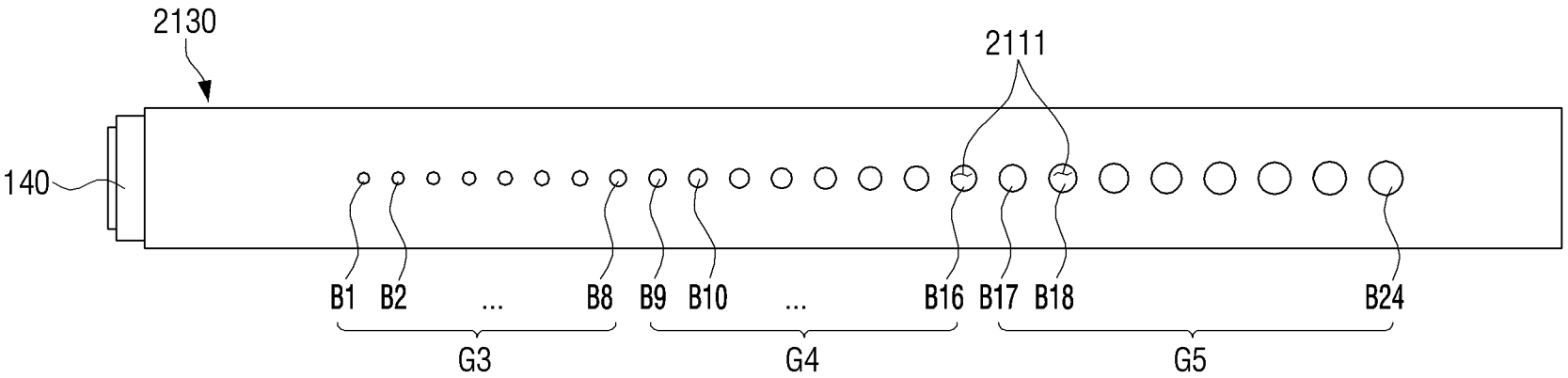
FIG. 11 is a top view illustrating a sound guide part, according to another embodiment.

FIG. 11 is a top view illustrating a sound guide part 2130 according to another embodiment. FIG. 12 is a graph illustrating a diameter of a plurality of openings 2111 of FIG. 1 in accordance with a distance from an acoustic transducer.

The plurality of openings 2111 may be, as described above, formed on one side of the sound guide part 2130. The connection structure with the sound guide part 103 is the same as above and thus will not be further explained below for the sake of brevity.

Figure 12:
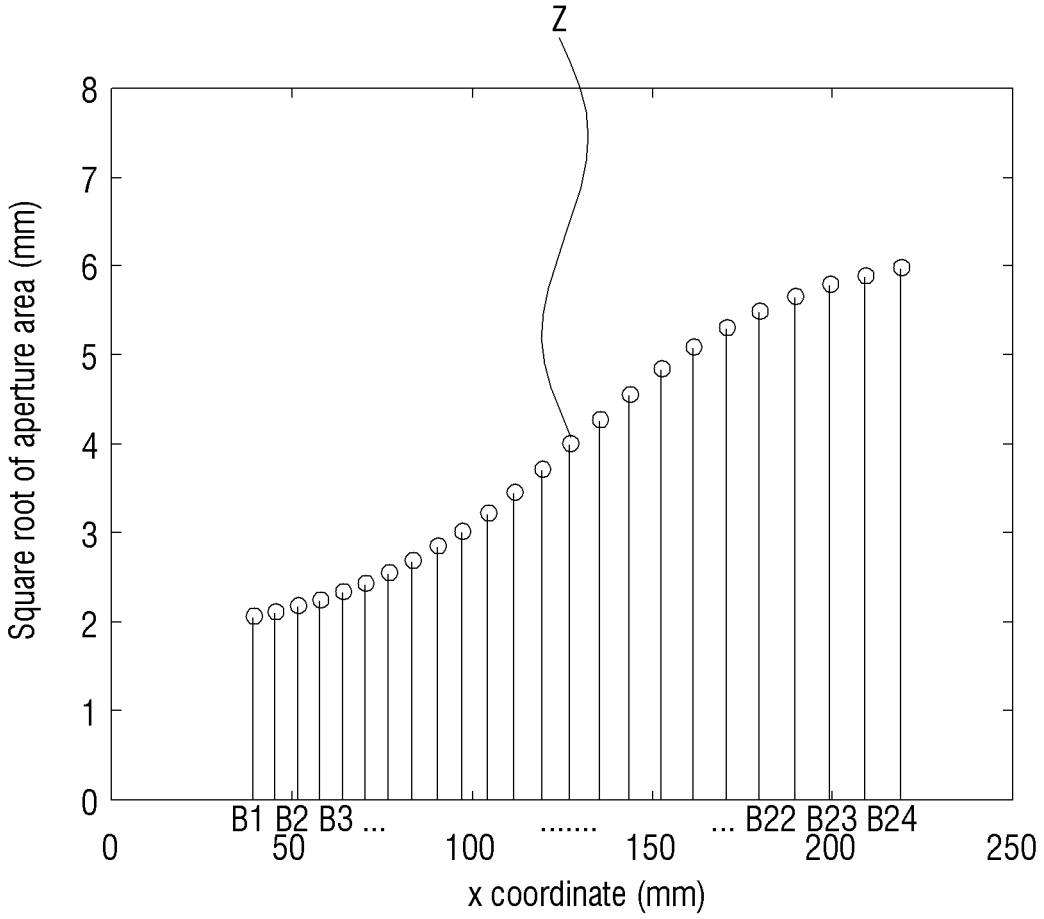
FIG. 12 is a graph that illustrates a change of diameters of a plurality of openings of FIG. 11 according to a distance from an acoustic transducer.

As illustrated in FIGS. 11 and 12, the sound guide part 2130 may include the plurality of openings 2111 and thereby, a diameter of the plurality of openings 2111 is increased as a distance from the acoustic transducer 140 increases. However, a ratio in which a diameter of the plurality of openings 2111 is increased may differ. That is, a ratio of diameter increase of the plurality of openings 2111 may be non-linear.

In detail, as illustrated in FIG. 12, as a distance from the plurality of openings 211 to the acoustic transducer 140 is increased, a diameter of the plurality of openings 211 may increase so that the graph has a positive slope.

Further, a ratio of increase of the plurality of openings 2111 (fluctuation rate of slope) may be changed from positive to negative based on an inflection point Z positioned at a predetermined distance from the acoustic transducer 140.

That is, a ratio of diameter increase of the plurality of openings 211 may be increased and then gradually decreased.

For example, a first ratio at which a diameter of a third opening disposed before the inflection point Z is increased based on the inflection point may be smaller than a second ratio at which a diameter of a fourth opening disposed after the inflection point is increased.

In addition, in a case in which the plurality of openings 2111 are defined as a third opening G3, a fourth opening G4, and a fifth opening G5 in an order of departing from the acoustic transducer 140, a ratio of diameter increase of a plurality of openings B9-B16 included in the fourth opening G4 may be larger than a ratio of diameter increase of a plurality of openings B1-B8 included in the third opening G3 and a ratio of diameter increase of a plurality of openings B17-B24 included in the fifth opening G5.

As another example, a size of each of the plurality of openings 2111 may be increased based on the reflection point Z positioned at a predetermined distance according to a regularity of increase in a ratio ($\Delta\sqrt{A}/\Delta x$) of increments of a square root value $\sqrt{A}$ of a size A of each of the openings to a distance between the openings ($\Delta x$).

Inversely, at a position after the inflection point Z, a size of each of the openings may be increased according to a regularity that a ratio ($\Delta\sqrt{A}/\Delta x$) is decreased.

Meanwhile, a size of the plurality of openings 2111 may be increased up to a position of the reflection point Z according to a regularity that ratios of increments of a square root value $\sqrt{A}$ of a size A of each of the openings to a distance between the openings ($\Delta x$) are identical to one another.

Inversely, at a position after the inflection point Z, it may be implemented such that sizes of the plurality of openings 2111 are not changed or similar to each other.

However, if necessary, the number of a plurality of openings included in the third to fifth openings G3-G5 may be different.

Accordingly, the sensitivity and the directivity of the sound guide part 2130 according to another embodiment may be improved as compared with the sensitivity and the directivity of the sound guide part 130 including a plurality of openings of which a diameter is steadily increased according to an embodiment.

FIGS. 13A, 13B, 13C, and 13D are perspective views illustrating a sound guide part according to yet another embodiment. As illustrated in the drawings, a plurality of openings may be a circular shape but may have the shape of a symmetrical rectangle of which a ratio of width to length is variously modified.

Figure 13A:
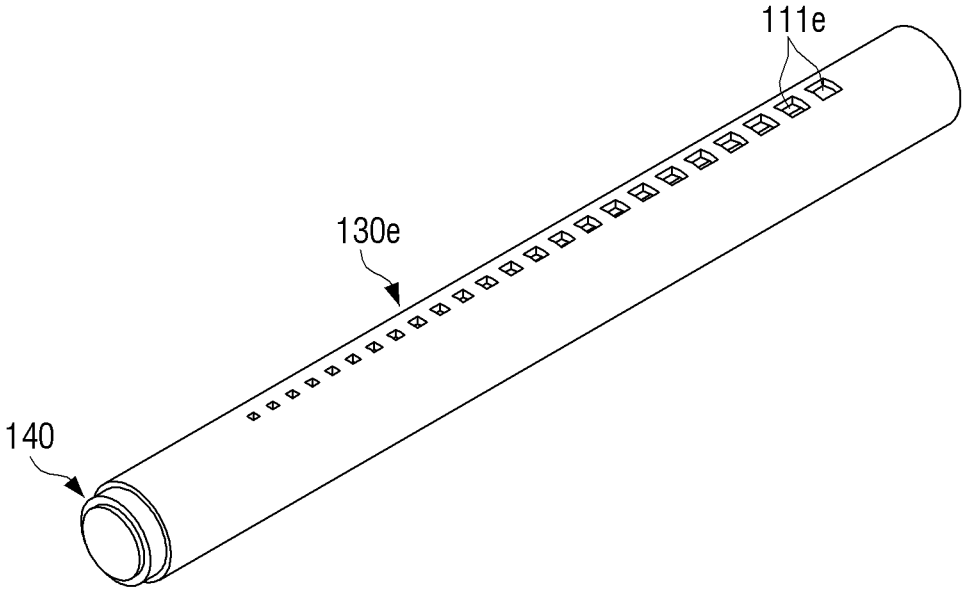
FIGS. 13A, 13B, 13C, and 13D are perspective views illustrating a sound guide part according to yet another embodiment.
Figure 13B:
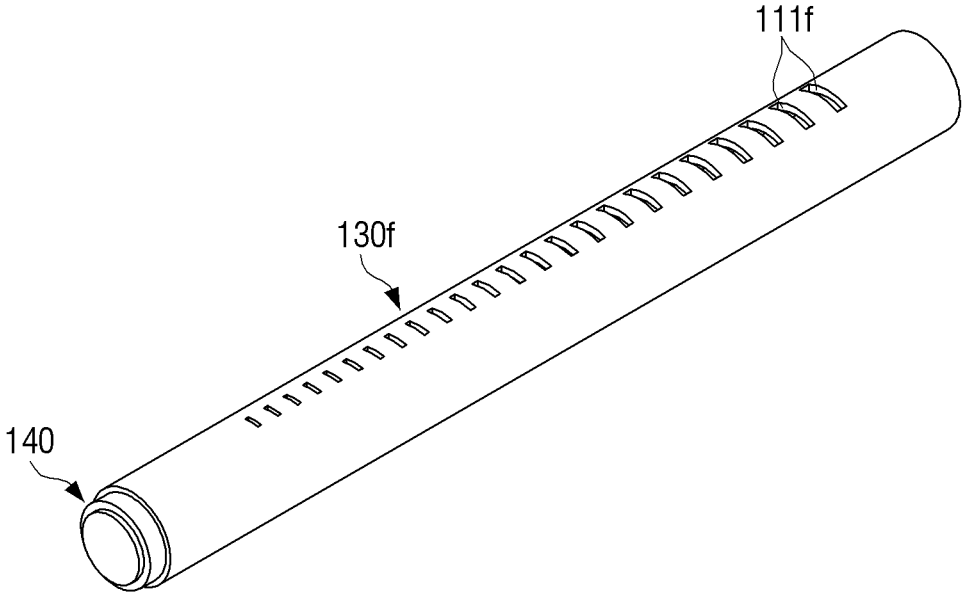

As illustrated in FIGS. 13A and 13B, a plurality of openings 111*e* and 111*f* may be symmetrical like a rectangle. However, in an implementation, the opening may be formed in various different shapes such as a rectangle, a square, a rhombus, and the like.

Further, a size of the plurality of openings 111*e* and 111*f* may be increased along a longitudinal direction of the sound guide parts 130*e* and 130*f* as a distance from the acoustic transducer 140 increases.

Accordingly, the directivity and the sensitivity of the sound outputting apparatus can be adjusted through not only a plurality of circular openings but also a plurality of rectangular openings 111*e* and 111*f*.

Figure 13C:
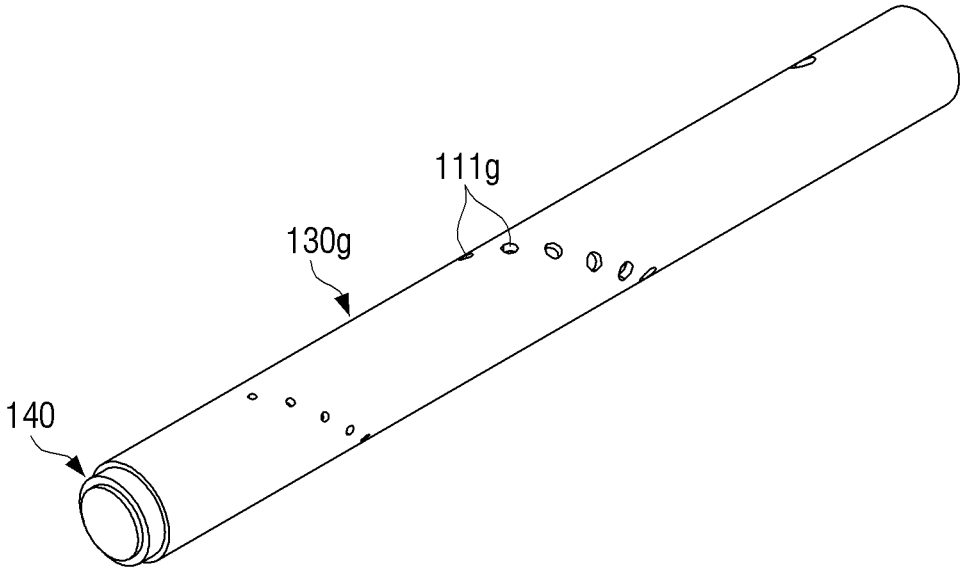

As illustrated in FIG. 13C, a plurality of openings 111*g* may be disposed on a sound guide part 130*g* along a circumference of the sound guide part 130*g*.

For example, when the sound guide part 130*g* is circular, the plurality of openings 111*g* may be disposed along a circumference of the sound guide part 130*g* along a longitudinal direction of the sound guide part 130*g*.

Figure 13D:
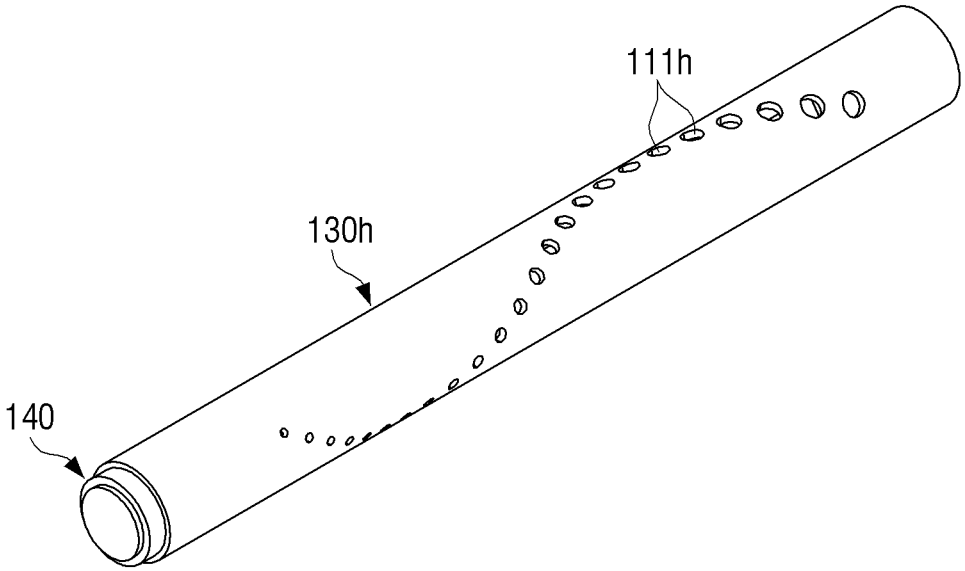

Further, as illustrated in FIG. 13D, the sound guide part 130*h* may include a plurality of openings 111*h* which are disposed along a longitudinal direction of the sound guide part 130*h*. At least two openings from among the plurality of openings 111*h* may be disposed to have a deviation with respect to a perpendicular direction of a longitudinal direction of the sound guide part 130*h*.

That is, the plurality of openings 111*h* may be disposed with a sinusoidal wave pattern along a longitudinal direction of the sound guide part 130*h*. However, a pattern with which the plurality of openings 111*h* are disposed is not limited to a sinusoidal wave, and the openings may be disposed with various curved patterns.

In addition, the plurality of openings 111*h* disposed in a row may be disposed in zigzags.

Accordingly, by arranging the plurality of openings 111*h* in a uniformly dispersed pattern, it is possible to improve the directivity of sound waves in a specific direction, particularly in the longitudinal direction of the sound guide part 130*h*.

Figure 14:
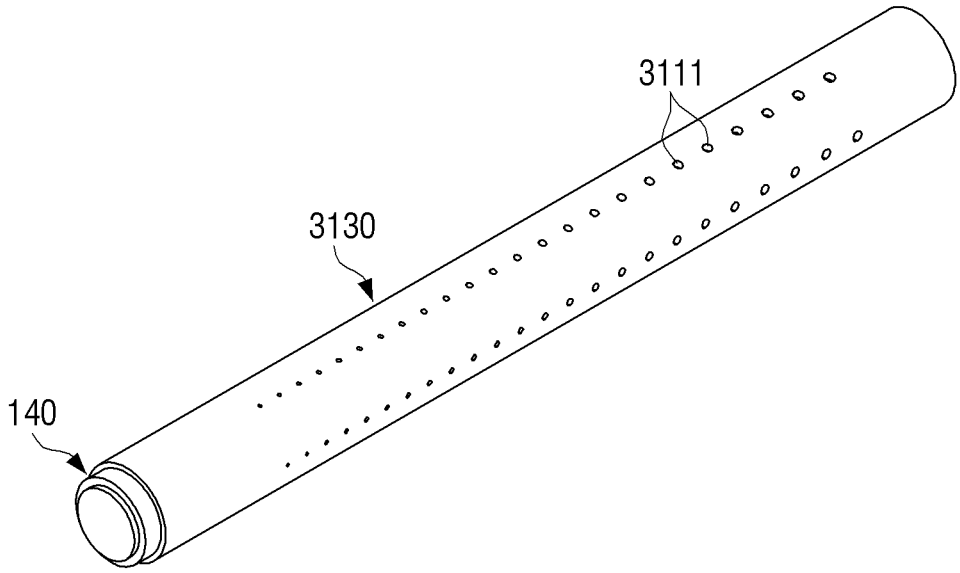
FIG. 14 is a perspective view illustrating a sound guide part, according to yet another embodiment.

FIG. 14 is a perspective view illustrating a sound guide part 3130, according to yet another embodiment.

The plurality of openings 3111 may be, as described above, formed on one side of the sound guide part 3130. The connection structure with the sound guide part 103 is the same as above and thus will not be further explained below for the sake of brevity.

As illustrated in FIG. 14, the plurality of openings 3111 may be disposed in a plurality of rows along a longitudinal direction of the sound guide part 3130.

For example, as illustrated in FIG. 14, the sound guide part 3130 may include a plurality of openings 3111 which are disposed in a plurality of rows along a longitudinal direction of the sound guide part 3130.

The plurality of rows may be disposed in parallel with each other as illustrated in FIG. 14.

Meanwhile, in an implementation, the plurality of openings 3111 may be disposed in zigzags with respect to a longitudinal direction of the sound guide part 3130.

Further, the plurality of openings may be disposed in a plurality of rows along a longitudinal direction of the sound guide part. The plurality of rows may be disposed at predetermined intervals, and each of the plurality of rows may be freely disposed by a straight line, a curved line, or the like.

When a cross-section of the sound guide part 3130 has a circular shape, that is, when the sound guide part is cylindrical, the plurality of openings 3111 may be disposed in a plurality of rows along a circumference of the sound guide part 3130.

The plurality of rows may be disposed at predetermined intervals or at different intervals as needed.

Accordingly, the sensitivity of a sound pressure level can be increased due to an increase of the plurality of openings 3111, and a directivity toward a side direction can be enhanced through a pattern disposed in a plurality of rows.

Figure 15:
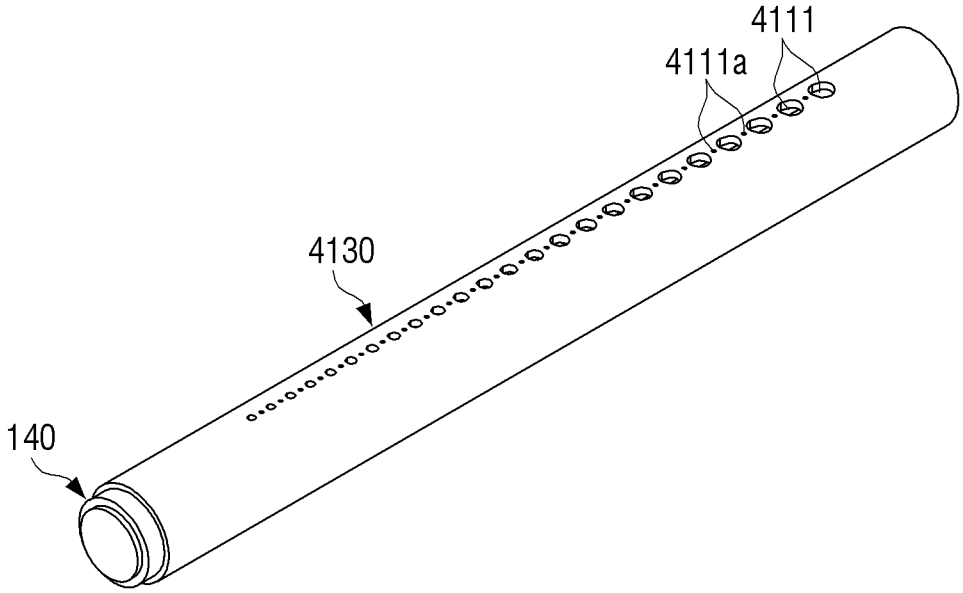
FIG. 15 is a perspective view illustrating a sound guide part, according to yet another embodiment.

FIG. 15 is a perspective view illustrating a sound guide part 4130, according to yet another embodiment.

The plurality of openings 4111 may be, as described above, formed on one side of the sound guide part 4130. The connection structure with the sound guide part 103 is the same as above and thus will not be further explained below for the sake of brevity.

As illustrated in FIG. 15, the plurality of openings 4111 disposed along a longitudinal direction of the sound guide part 4130 may be disposed, and additional openings 4111*a* may be disposed between the plurality of openings 4111.

The additional openings 4111*a* may be connected to the sound guide space 103 and may be of a smaller diameter than the plurality of openings 4111.

However, in an implementation, a diameter of the additional openings 4111*a* may be larger than or equal to a diameter of the plurality of openings 4111.

In addition, in an implementation, the additional openings 4111*a* may be of various shapes such as a circle, a polygon, or the like.

Accordingly, through the additional openings 4111*a*, it is possible to precisely adjust the directivity and the sensitivity of the sound outputting apparatus 1.

Further, a ratio of the sum of all surface areas of a plurality of openings formed on a surface of the sound guide part described above to a surface area of a sound guide part on which a plurality of openings are not formed may be in the range of $10^{-6}$ to 0.35. Accordingly, an embodiment is not limited to the shape and the pattern of the plurality of openings, and it is possible to improve the sensitivity of the sound waves in various frequency areas while maintaining the directivity at a specific level.

The various embodiments aforementioned were explained separately, but each of the embodiments may not necessarily be realized separately, and the configuration and operation of each of the embodiments may be realized in combinations with at least one other embodiment.

The foregoing embodiments are merely exemplary and are not to be construed as limiting the present disclosure. The present disclosure can be readily applied to other types of apparatuses. Also, the description of exemplary embodiments are intended to be illustrative only, and not to limit the scope of the claims and their equivalents, and many alternatives, modifications, and variations will be apparent to those skilled in the art.

What is claimed is:

1. A sound outputting apparatus, comprising:

at least one loudspeaker; and a main body configured to house the at least one loudspeaker, wherein each of the at least one loudspeaker comprises:

an acoustic transducer configured to generate a sound wave; and a sound guide part configured to directionally output the sound wave via a plurality of openings, wherein a diameter of each of the plurality of openings is increased as a distance from the acoustic transducer increases, and wherein the diameter of each of the plurality of openings is increased at a non-linear ratio along a longitudinal direction of the sound guide part.

2. The sound outputting apparatus as claimed in claim 1, wherein the plurality of openings comprises:

a plurality of first openings each having a diameter that steadily increases as a distance from the acoustic transducer increases along longitudinal direction of the sound guide part; and a plurality of second openings consecutively disposed following the plurality of first openings and each of the plurality of second openings having a same diameter.

3. The sound outputting apparatus as claimed in claim 1, wherein the plurality of openings comprises:

a plurality of third openings each having a diameter that steadily increases according to a first ratio as a distance from the acoustic transducer increases along a longitudinal direction of the sound guide part; and a plurality of fourth openings consecutively disposed following the plurality of third openings, and each of the plurality of fourth openings having a diameter that is steadily increased according to a second ratio as a distance from the plurality of third openings increases, wherein the first ratio is larger than the second ratio.

4. The sound outputting apparatus as claimed in claim 1, wherein the plurality of openings are disposed in a plurality of rows along the longitudinal direction of the sound guide part.

5. The sound outputting apparatus as claimed in claim 1, wherein the plurality of openings are disposed of a sinusoidal wave pattern along the longitudinal direction of the sound guide part.

6. The sound outputting apparatus as claimed in claim 1, wherein the sound guide part is a bar-shaped, and wherein the plurality of openings are disposed in a pattern that covers a circumference of the sound guide part.

7. The sound outputting apparatus as claimed in claim 1, wherein additional openings each having a smaller diameter than any of the plurality of openings are respectively disposed between adjacent openings of the plurality of openings.

8. The sound outputting apparatus as claimed in claim 1, wherein a cross-section of the sound guide part has a circular shape, wherein a cross-sectional area of the sound guide part decreases from a first end of the sound guide part to a second end of the sound guide part, and wherein the acoustic transducer is disposed at the first end of the sound guide part.

9. The sound outputting apparatus as claimed in claim 1, further comprising an acoustic resistant member, wherein the acoustic transducer is disposed at a first end of the sound guide part, and the acoustic resistant member is disposed at a second end of the sound guide part.

10. The sound outputting apparatus as claimed in claim 1, wherein the sound guide part comprises:

a protrusion member configured to be protruded from inside the sound guide part toward an inner direction and to filter out the sound wave generated in the acoustic transducer in a particular frequency band.

11. The sound outputting apparatus as claimed in claim 10, wherein a cross-sectional area of the protrusion member is 0.1 to 0.7 times a cross-sectional area of the sound guide part.

12. The sound outputting apparatus as claimed in claim 10, wherein a distance from a first end of the sound guide part at which the acoustic transducer is disposed to the protrusion member is less than 0.2 times a largest diameter of an inner cross-sectional area of the sound guide part.

13. The sound outputting apparatus as claimed in claim 1, further comprising:

a pipe member disposed between a first end of the sound guide part and the acoustic transducer, wherein the pipe member filters out the sound wave in a particular frequency band.

14. A loudspeaker, comprising:

an acoustic transducer configured to generate a sound wave; and a sound guide part configured to directionally output the sound wave via a plurality of openings, wherein the acoustic transducer is configured to be disposed at one end of the sound guide part and to transfer the sound wave to the sound guide part, wherein the plurality of openings are disposed along a longitudinal direction of the sound guide part, and wherein a diameter of each of the plurality of openings is increased as a distance from the acoustic transducer increases, and wherein the diameter of each of the plurality of openings is increased at a non-linear ratio along the longitudinal direction of the sound guide part.

15. The loudspeaker as claimed in claim 14, wherein the plurality of openings comprises:

a plurality of first openings each having a diameter that steadily increases as a distance from the acoustic transducer increases along the longitudinal direction of the sound guide part; and a plurality of second openings consecutively disposed following the plurality of first openings and each of the plurality of second openings having a same diameter.

16. The loudspeaker as claimed in claim 14, wherein the plurality of openings comprises:

a plurality of third openings each having a diameter that steadily increases according to a first ratio as a distance from the acoustic transducer increases along the longitudinal direction of the sound guide part; and a plurality of fourth openings consecutively disposed following the plurality of third openings, and each of the plurality of fourth openings having a diameter that is steadily increased according to a second ratio as a distance from the plurality of third openings increases, wherein the first ratio is larger than the second ratio.

17. The loudspeaker as claimed in claim 14, wherein the plurality of openings are disposed in a plurality of rows along the longitudinal direction of the sound guide part.

18. The loudspeaker as claimed in claim 14, wherein the sound guide part comprises:

a protrusion member configured to be protruded from inside the sound guide part toward an inner direction and to filter out the sound wave generated in the acoustic transducer in a particular frequency band.

* * * * *